US005274390A

United States Patent [19]

Breakall

[11] Patent Number: 5,274,390

[45] Date of Patent: Dec. 28, 1993

[54] FREQUENCY-INDEPENDENT PHASED-ARRAY ANTENNA

[75] Inventor: James K. Breakall, Port Matilda, Pa.

[73] Assignee: The Pennsylvania Research Corporation, University Park, Pa.

[21] Appl. No.: 802,961

[22] Filed: Dec. 6, 1991

[51] Int. Cl.[5] ..... H01Q 11/10

[52] U.S. Cl. ..... 343/792.5; 343/797; 343/853

[58] Field of Search ..... 343/792.5, 797, 853; 342/368

[56] References Cited

U.S. PATENT DOCUMENTS

| | | | |
|---|---|---|---|
| 3,134,979 | 5/1964 | Bell | 343/792.5 |
| 3,249,946 | 5/1966 | Flanagan | 343/792.5 |
| 3,257,661 | 6/1966 | Tanner | 343/792.5 |
| 3,266,044 | 8/1966 | Bresler | 343/792.5 |
| 3,271,774 | 9/1966 | Justice | 343/792.5 |
| 3,308,470 | 3/1967 | Bell | 343/792.5 |
| 3,349,404 | 10/1967 | Copeland et al. | 343/120 |
| 3,355,739 | 11/1967 | Bell et al. | 343/792.5 |
| 3,366,964 | 1/1968 | Ramsay et al. | 343/792.5 |
| 3,369,243 | 2/1968 | Greiser | 343/770 |
| 3,460,150 | 8/1969 | Mei | 343/792.5 |
| 3,482,250 | 12/1969 | Maner | 343/766 |
| 3,530,484 | 9/1970 | Barbano et al. | 343/792.5 |
| 3,550,138 | 12/1970 | Guertler et al. | 343/792.5 |
| 3,765,022 | 10/1973 | Tanner | 343/792.5 |
| 3,868,689 | 2/1975 | Liu et al. | 343/101 |
| 4,506,268 | 3/1985 | Kuo | 343/792.5 |
| 4,594,595 | 6/1986 | Struckman | 343/770 |

*Primary Examiner*—Michael C. Wimer
*Attorney, Agent, or Firm*—Thomas J. Monahan

[57] ABSTRACT

A phased antenna array is described that includes a conductive ground plane and a plurality of log-periodic antennas, each antenna having a plurality of radiating elements, each radiating element having a resonant frequency. Each log-periodic antenna extends from a common feed region at an acute angle with respect to the conductive ground plane, the angle assuring that all said radiating elements having a common resonant frequency exhibit an identical electrical distance from each other and from the ground plane.

10 Claims, 5 Drawing Sheets

FIG. 3

λ0 = WAVE LENGTH AT LOWEST FREQUENCY

λ1 = WAVE LENGTH AT HIGHEST FREQUENCY

FREQUENCY-INDEPENDENT PHASED-ARRAY ANTENNA

FIELD OF THE INVENTION

This invention relates to log-periodic antennas and, more particularly, to a phased-array of log-periodic antennas.

BACKGROUND OF THE INVENTION

Phased-array antennas have traditionally been composed of a group of similar, individual element antennas or radiators oriented along a line (a linear array) or in a two-dimensional plane (a planar array). These configurations have provided the ability to form, a single, directed, pencil-beam, fan beam or even multiple beams. The formation and characteristics of the beam or beams was controlled, entirely, by amplitude and phase excitations of individual element radiators in the antennas. The main beam was scanned in space by changing the phasing and excitation of individual radiating elements. The shape of the beam (its width and sidelobes) was controlled by amplitude, phasing and spacing of the radiating elements. Scanning of the beam was accomplished completely electronically.

Phased arrays have been used in many applications including electronically steered radar, shortwave broadcasting, curtain arrays, over-the-horizon radars, ionospheric modification antennas, satellite communications, broadcasting antennas, AM broadcast service antennas, etc., etc.

A linear phased-array antenna usually includes N elements, elements equally spaced some distance d apart along a geometric line. The spacing d, when represented in wavelengths, determines the number and position, spatially, of all lobes that are generated by the antenna. Those lobes include a main beam lobe, minor sidelobes and grating lobes which are exact replicas of the main beam lobe. Usually, the antenna designer wishes to reduce all lobes except the main beam lobe, since the other lobes radiate energy in undesired directions. Minor sidelobes can be reduced to very small levels by tapering the amplitude of excitation of individual radiating elements. Grating lobes, on the other hand, can be controlled only by the wavelength spacing of the elements.

For a main beam pointing broadside to the plane of the radiating elements (0 degree scan angle), the maximum theoretical spacing between elements is one wavelength before the grating lobes begin to appear in the radiation pattern. Spacings between radiating elements of under one wavelength will insure that only minor sidelobes appear and will further assure the absence of grating lobes. Spacings of a half wavelength or less will insure that grating lobes do not appear when the radiation pattern is slewed over a variety of direction angles. Array spacings are therefore chosen, in practice, to be usually between 0.5 and 1 wavelength to eliminate all grating lobes and to allow techniques of amplitude tapering to be used to control minor sidelobes.

Because of the spacing requirements described above, phased-arrays have generally been constructed to operate only over a limited frequency range. This is because the spacing in wavelengths changes in direct proportion to frequency changes.

Many phased array antenna radiating elements are elementary dipole structures that exhibit physical dimensions close to 0.5 wavelengths in extent. This restricts the minimum spacing between centers of such elements to be just slightly greater than 0.5 wavelengths, to prevent structure overlapping. If the antenna's beam is to be directed in a broadside direction (0 degree scan angle), then the maximum spacing in wavelengths must not exceed 1 wavelength, as stated above. Where the spacing of radiating elements is 0.5 wavelengths at one frequency, if the frequency is doubled the radiating element spacing becomes 1 wavelength. Such a phased-array arrangement will thus operate over a 2:1 frequency range with acceptable performance for a 0 degree scan angle. At frequencies above twice the excitation frequency, grating lobes will appear which can no longer be eliminated by amplitude tapering.

If a phased-array is to be designed to have a slewing capability (e.g., out to as much as a +/−40 degree scan angle), then the situation becomes more difficult. In such case, a grating lobe will appear when the spacing is 0.6 wavelengths or greater. For such an array (with 0.5 wavelength spacing at its lowest frequency) the phased-array will only have a 1.2:1 frequency range in order to insure no grating lobes. The use of wideband antenna elements in a phased array will allow radiation in the main beam direction over a wide band, but will also suffer from severe pattern degradation due to many extra grating lobes in unwanted directions.

There is a need to have phased-array antenna systems which exhibit frequency independent operation over a wide bandwidth, with little or no degradation of performance as a result of undesired grating lobes. In addition, such phased-arrays should exhibit constant gain and beamwidth characteristics, satisfactory impedance response and be of simple construction.

A known wideband radiating element is the log-periodic antenna which has been used widely in many different configurations. The log-periodic antenna includes a longitudinal axis along which runs a balanced feedline to a plurality of orthogonal radiating elements. The radiating elements are generally coplanar and increase in length in a logarithmic fashion from the antenna's feed end to the antenna's far end. If paired radiating elements extend from the antenna, they are generally equal in length and extend in opposite directions normal to the longitudinal axis. Each radiating element exhibits a resonant frequency within the bandwidth of the antenna. Thus, when the antenna is energized with a signal frequency that matches the resonant frequency of a radiating element, only that radiating element becomes active and emits a radiation pattern. By varying the frequency, a variety of elements along the antenna's longitudinal axis can be made active. In general, the radiating pattern of a log-periodic antenna is co-linear with the longitudinal axis of the antenna.

The prior art contains many patents detailing various aspects of log-periodic antennas. A number of those patents relate to individual antenna structures. Such disclosure can be found in U.S. Pat. Nos. 3,134,979 and 3,308,470, both to Bell; 3,271,774 to Justice; 3,355,739 to Bell et al.; 3,366,964 to Ramsay et al.; 3,369,243 to Greiser; 3,482,250 to Maner; 3,530,484 to Barbano et al. and 3,868,689 to Liu et al. Each of the aforesaid patents discloses a structure of a log-periodic antenna; a method or apparatus for mounting such an antenna; a method or apparatus for feeding such an antenna; or a use of a particular antenna structure.

Log-periodic antennas have also been employed in arrays. In U.S. Pat. No. 3,349,404 to Copeland et al., an integrated array of log-periodic antennas and their circuitry is disclosed. The circuitry is used to switch the main lobe of the antenna over a narrow range for homing purposes. In U.S. Pat. No. 3,460,150 to Mei, a broadside, log-periodic antenna is shown wherein different lengths and configurations of feedlines to radiating elements are chosen so as to insure correct phasing relationships when all antennas are fed in parallel from a single excitation source. Mei arranges his antennas in rows and files in a substantially common plane, with the files extending from a common origin and the rows being transverse and spaced apart according to a logarithmic function. Mei discloses no ground plane for use in conjunction with his radiating elements.

In U.S. Pat. No. 4,506,268 to Kuo, a pair of log-periodic antennas are arranged in an array which is rotated around a central point. In U.S. Pat. No. 4,594,595 to Struckman, individual log-periodic antennas are arranged rotationally around a central point on a flat planar disk. Each antenna has its own individual feed point and can be thought of as having a single directional beam in the direction of orientation.

None of the aforesaid prior art achieves a wide-band phased-array that enables the generation of a radiation pattern that is grating-free over a wide slew angle.

Accordingly, it is an object of this invention to provide a wide-band, phased-array antenna using log-periodic radiating elements.

It is another object of this invention to provide a wide-band, phased-array antenna that exhibits a wide slew angle without the production of grating lobes.

It is another object of this invention to provide a wide-band, phased-array antenna employing log-periodic elements that requires no physical adjustment to achieve wide-band slew operation.

SUMMARY OF THE INVENTION

A wide-band phased antenna array is described that includes a conductive ground plane and a plurality of log-periodic antennas, each antenna having a plurality of radiating elements, each radiating element having a resonant frequency. Each log-periodic antenna extends from a common feed region at an acute angle with respect to the conductive ground plane, the angle assuring that all radiating elements having a common resonant frequency and exhibit an identical electrical distance from each other and from the ground plane.

DETAILED DESCRIPTION OF THE INVENTION

Figure 1:
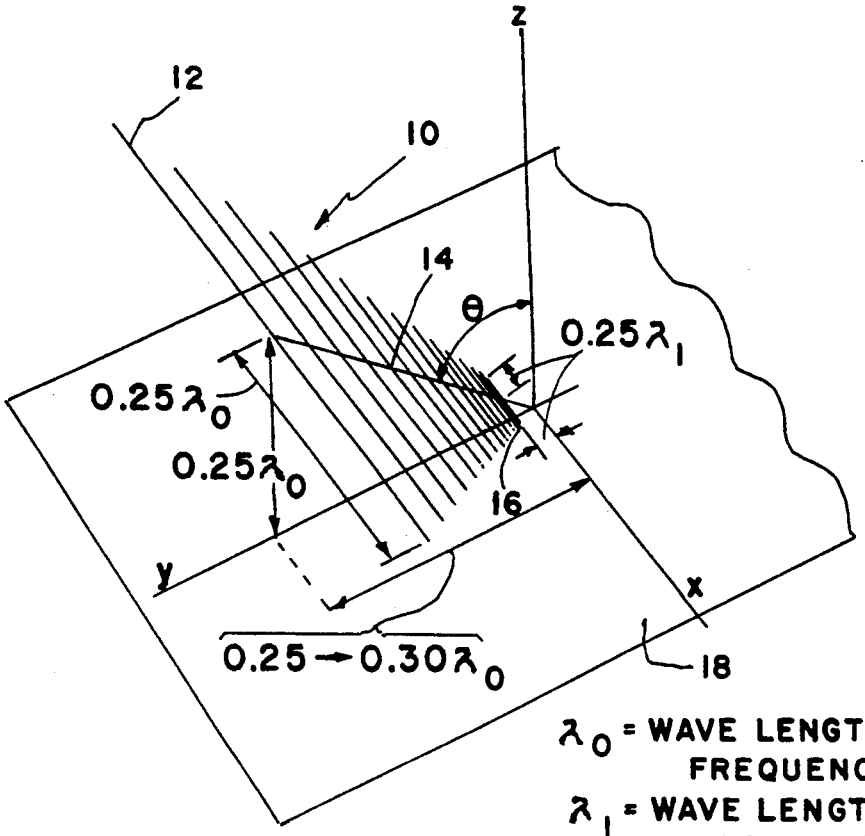
FIG. 1 is a schematic of a log-periodic antenna employed with the invention, illustrating its relationship to an xyz coordinate system and wherein a ground plane is positioned in the xy plane.

Referring now to FIG. 1, the basic antenna element used in this invention is an antenna 10 which is a wire version of a planar dipole, log-periodic antenna. While not shown, each individual element is fed via a two wire feed system. As indicated above, log-periodic antennas are well known in the art and include a plurality of radiating elements, each element resonant at a different frequency. The specific log-periodic antenna shown in FIG. 1 is shown for exemplary purposes only and other log-periodic constructs arranged as taught herein may be substituted therefor.

Each radiating element in antenna 10 exhibits an electrical length that is 0.5 wavelengths at the element's resonant frequency. Thus, the longest element 12 comprises two portions that extend from center feed 14 and together exhibit an electrical length of 0.5 wavelengths at the lowest frequency ($\lambda_0$) employed to energize antenna 10. In a like manner, antenna element 16 also has two separate portions, the electrical length thereof being 0.5 wavelengths at the highest frequency ($\lambda_1$) of excitation employed with antenna 10. A ground plane 18 is positioned in the xy plane.

Antenna 10 is oriented at an angle $\theta$ with respect to the xz plane of FIG. 1. Angle $\theta$ is chosen so that each radiating element exhibits an identical electrical distance (expressed in wavelengths) from ground plane 18. Furthermore, as will be understood from the description below, all radiating elements exhibit electrical distances from each other (expressed in wavelengths) that are identical.

Figure 2:
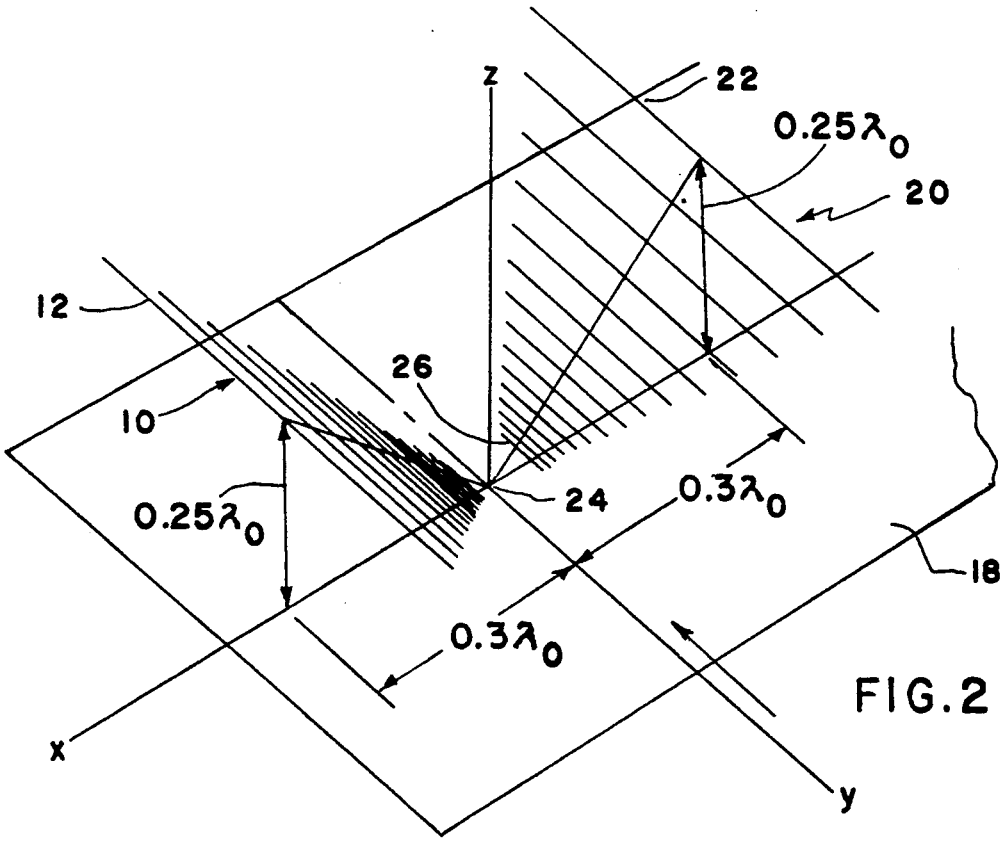
FIG. 2 shows an added log-periodic antenna that is the mirror image of the antenna of FIG. 1.

Referring to FIG. 2, an additional antenna 20 has been added as a mirror image of antenna 10. While both antennas 10 and 20 are schematically illustrated as geometrically emanating from a central feed point 24 (that is coincident with ground plane 18), antennas 10 and 20 are fed separately from an energy source (or sources) whose phase can be adjusted.

Radiating element 22 in antenna 20 is located an identical electrical distance from the yz plane as is radiating element 12 of antenna 10. Similarly, all other radiating elements within antenna 20 exhibit identical electrical distances from the yz plane, as do the mirror image elements of antenna 10. This arrangement enables all radiating antenna elements that exhibit the same resonant frequency to also exhibit the same electrical distances between each other. In addition, all of the radiating elements in both antennas 10 and 22 exhibit an identical electrical distance from ground plane 18.

The electrical height of the radiating elements above ground plane 18 is determined by the range of slewing or scanning angle of the antenna beam, as measured from the broadside direction of the array (the "zenith" direction that is coincident with the z axis). A height of 0.25 wavelengths will insure a beam slewing range of from 0 degrees to +/−40 degrees from zenith with little loss of gain. Reduced gains will occur for scanning angles greater than 40 degrees. To produce higher gains and greater scan angles from zenith requires that greater electrical heights from ground plane 18 be chosen for the radiating elements.

Those skilled in the art will understand that the slew and gain pattern of a phased-array is determined by a combination of the free space array pattern in combination with the array's ground pattern, as determined from a single point above ground plane 18. The ground pattern has an approximate form of a circle that is tangent to feedpoint 24. The free space array takes the shape of a narrow beam emanating from feedpoint 24. The combined pattern of the antenna array is a multiplication of the ground pattern times the free space pattern. Thus, as the ground pattern beam exceeds 30 to 40 degrees from zenith, the amount of gain contributed by the free space array pattern decreases rapidly.

If the electrical distance above ground of the radiating elements is increased to 0.5 wavelengths, the antenna array exhibits lobe maxima at plus 60 degrees and minus 60 degrees. If the height above ground is raised to a full wavelength, maxima lobes appear at 15 degrees, 30 degrees, minus 15 degrees and minus 30 degrees, etc. During the further discussion of the invention, it will be assumed that the 0.25 wavelength height above ground plane 18 is chosen to provide a maximum scanning angle coverage of +40° from zenith.

The lowest frequency of operation of the antenna structure of FIG. 2 requires the highest physical height above ground plane 18 of the active radiating element. As above indicated, radiation occurs in a log-periodic structure where the radiating wire dimension is such as to be resonant at the frequency of excitation. This area is known as the active region. As can thus be seen, with both antennas 10 and 20 fed from central feedpoint 24 by a single frequency, identically positioned radiating elements become active. A plane drawn through these active elements will hereinafter be called a "radiating surface". As the frequency of excitation changes, the radiating surface varies in physical height above ground plane 18, but always remains at the same electrical distance therefrom. The shortest radiating element is resonant at the highest frequency of antenna operation. In antenna 20, the shortest element is element 26 and it too is 0.25 wavelengths above ground plane 18 and is the identical electrical distance from shortest electrical element 16 (exhibiting the same resonant frequency) in antenna 10.

As above indicated, grating lobes are additional lobes that have the same or nearly the same intensity as the main lobe. Grating lobes are a function of the wavelength spacing between elements and the angle at which the main beam is scanned from zenith. For most antenna array applications, it is undesirable to have grating lobes. The antenna array shown in FIG. 2 avoids such grating lobes by being positioned such that all radiating elements in a radiating surface are approximately 0.6 wavelengths apart. This enables a slewing of the main beam, plus or minus 30 degrees without the creation of grating lobes. If it is not desired to scan the array, then a radiating element-to-radiating element spacing of one wavelength or less may be used to avoid grating lobes. On the other hand, inter-radiating element spacings can be, at most, a half-wavelength if it is desired to scan the beam up to 90 degrees. If scanning from zenith to up to +/−30 degrees is required, inter-radiating element spacings of less than ⅔ of a wavelength must be used to avoid grating lobes.

Figure 3:
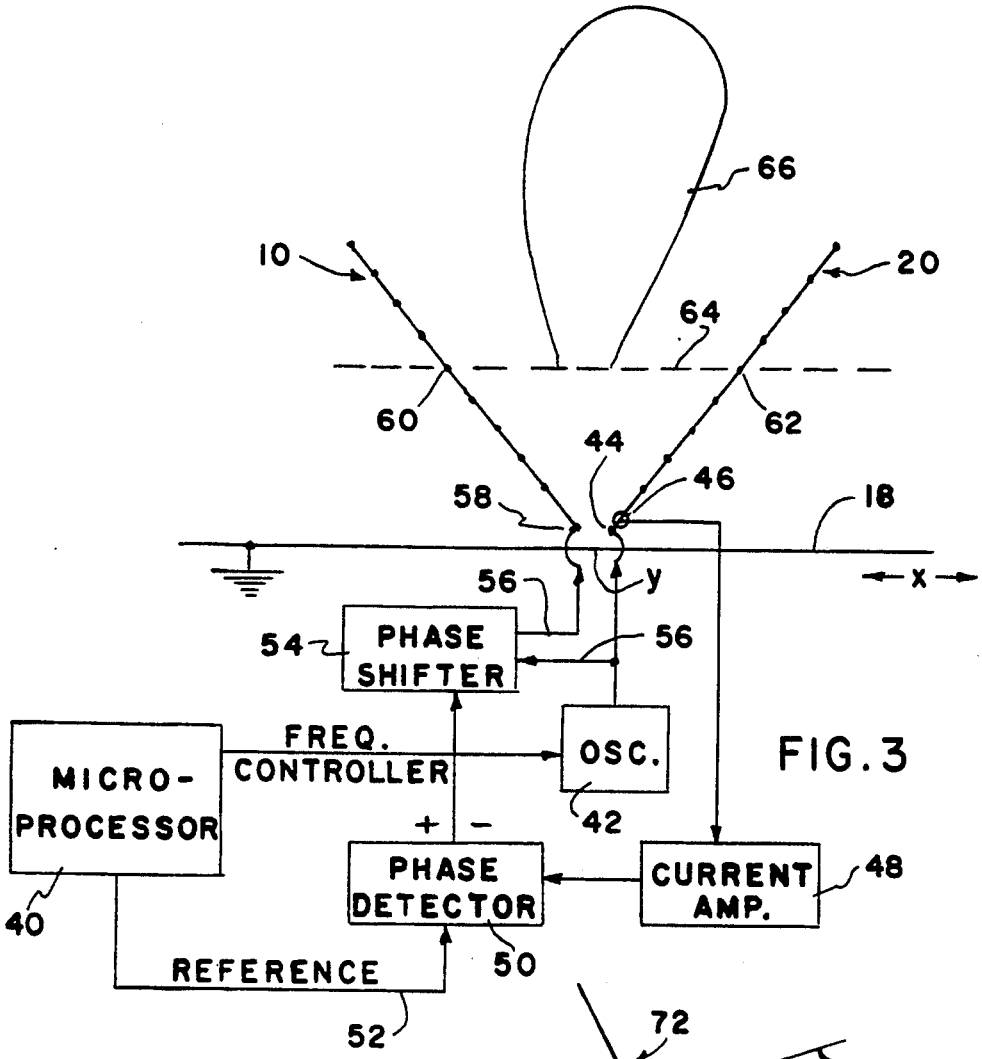
FIG. 3 is a schematic block diagram of a system for energizing the antenna array of FIG. 2.

Referring now to FIG. 3, a side view is shown of antennas 10 and 20, taken along the y axis of FIG. 2 and includes circuitry for energizing the respective antennas. A microprocessor 40 provides a frequency control input to oscillator 42 which, in turn, applies an energizing signal of frequency f to feedpoint 44 in antenna 20. The phase and amplitude of the energizing signal fed to antenna 20 is sensed by inductive sensor 46, which in turn supplies its output to current amplifier 48. The output from current amplifier 48 is applied to phase detector 50 which determines the phase difference between the applied signal and a reference phase provided over conductor 52 from microprocessor 40. The output from phase detector 50 is an error voltage that is applied to a phase shifter 54. Oscillator 42, in addition to providing an output to feedpoint 44 of antenna 20, also applies its output, via conductor 56, to phase shifter 54. The energizing signal is thus phase shifted in accordance with the error voltage provided from phase detector 50 and is then applied via conductor 56 to feedpoint 58 for antenna 10.

If it is assumed that frequency f is the resonant frequency of radiating elements 60 and 62, each of elements 60 and 62 becomes active when an energizing signal of frequency f is applied to feedpoints 44 and 58. As a result, a radiating surface 64 (shown dotted) is created, and, assuming the inputs to feedpoints 44 and 58 are in phase, a thin pencil beam 66 coincident with the z axis emanates therefrom. If it is desired to slew beam 6, microprocessor 40 alters the reference phase on conductor 52. This causes phase detector 50 to apply an error voltage to phase shifter 54, thereby causing a phase change in energization applied to antenna 10 which, in turn, causes beam 66 to slew in the known manner. Similarly, microprocessor 40 can cause the position of radiating surface 54 to change by altering the frequency of oscillator 42, so that other mirror-pair radiating elements become active.

The antenna arrangement shown in FIGS. 2 and 3 substantially alters the characteristics of the individual log-periodic antennas employed by the invention. Under normal circumstances, the main beams of a log-periodic antenna exhibit a coincident axes with the feed-line axis of the antenna. The phased-array of FIGS. 2 and 3 destroys the individual directionalities of log-periodic antennas 10 and 20 and causes them to combine to provide a slewable pencil beam whose directionality from a zenith direction is controlled by the phasing of signals applied to the antenna array.

Figure 4:
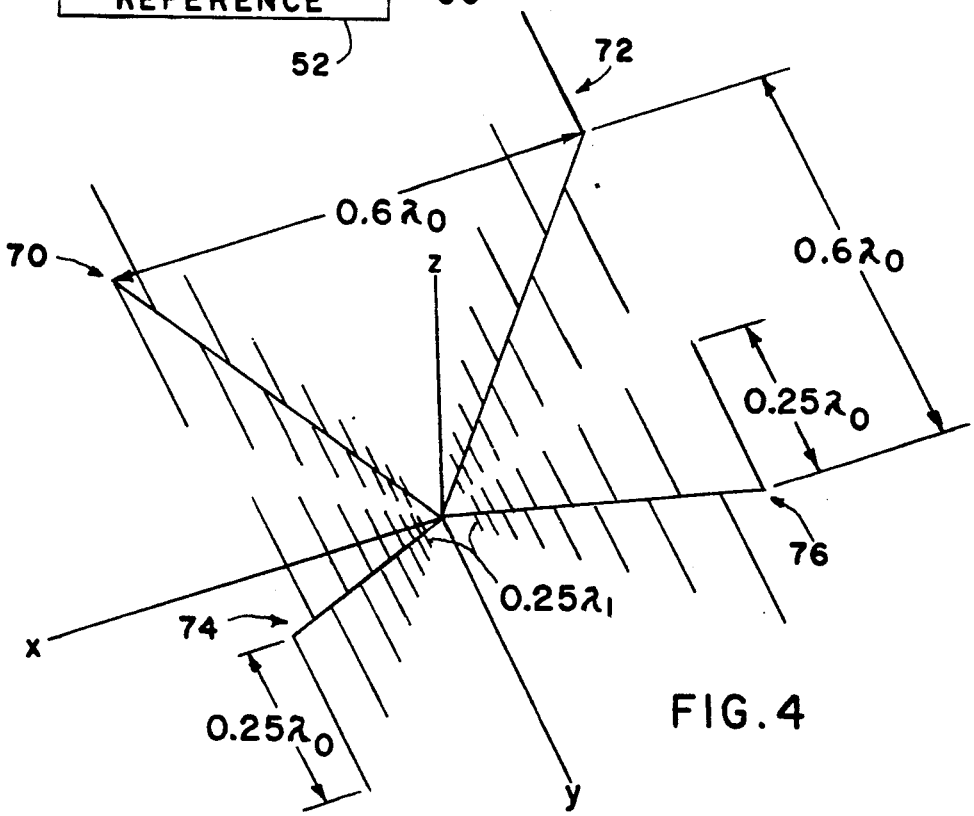
FIG. 4 is an array of four, log-periodic antennas, the array arranged in a manner incorporating the invention hereof.
Figure 5A:
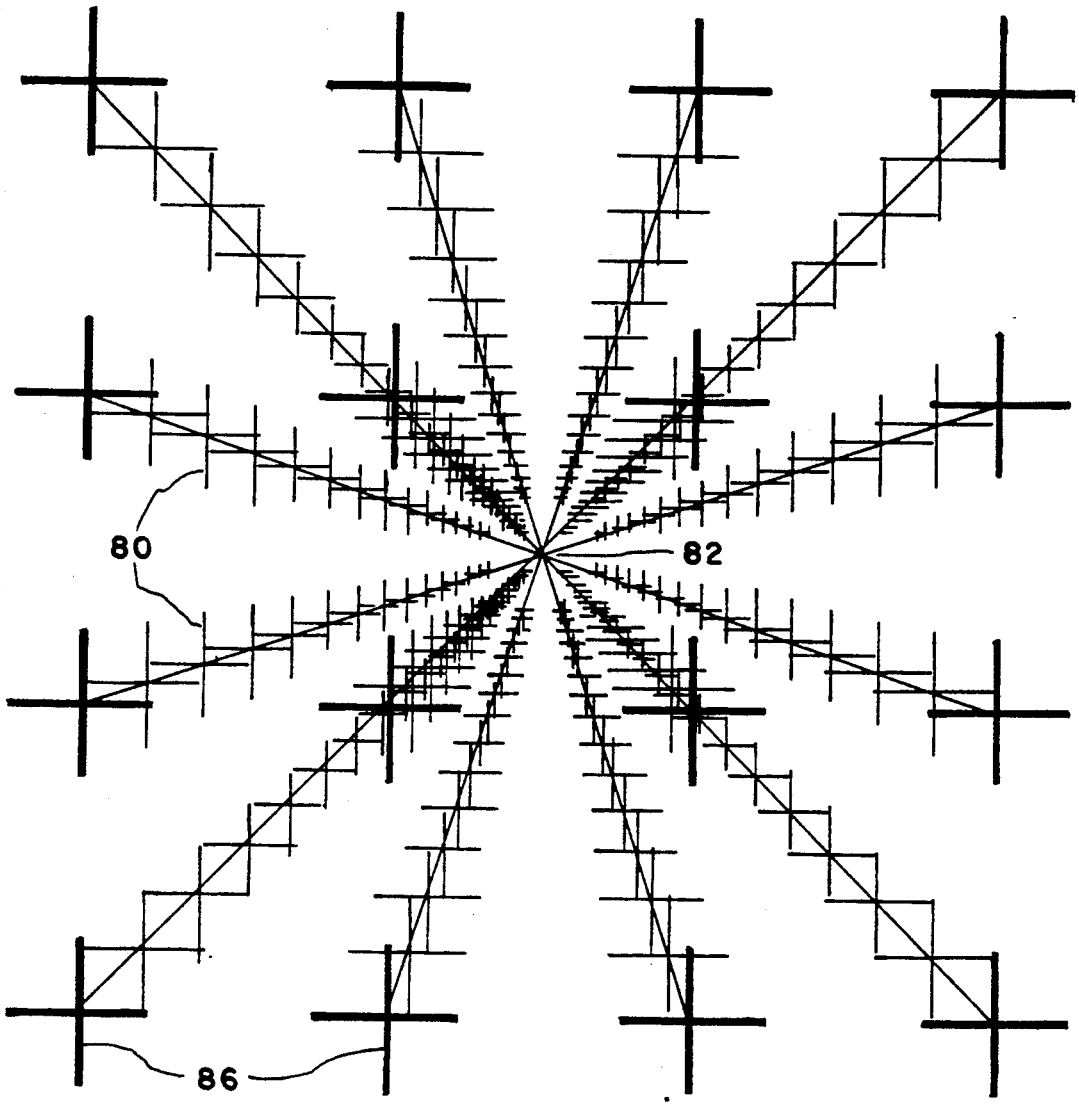
FIGS. 5*a*, 6*a* and 7*a* illustrate a schematic of a 4×4 array of log-periodic antennas, the array energized at three different excitation frequencies.
Figure 5B:
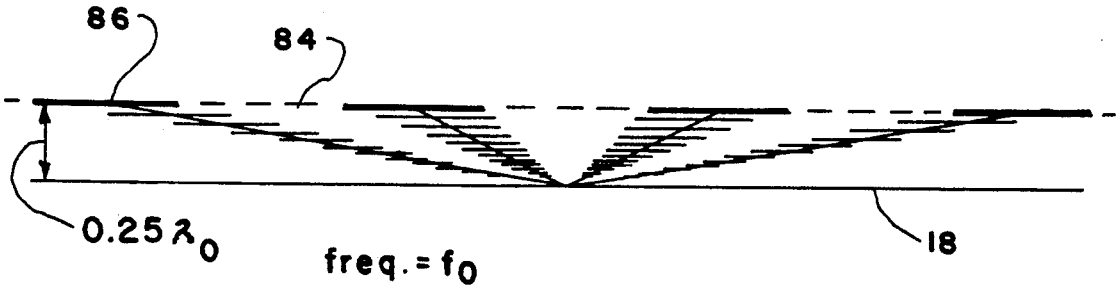
FIGS. 5*b*, 6*b* and 7*b* are side views of the array shown in FIGS. 5*a*, 6*a* and 7*a*.
Figure 6A:
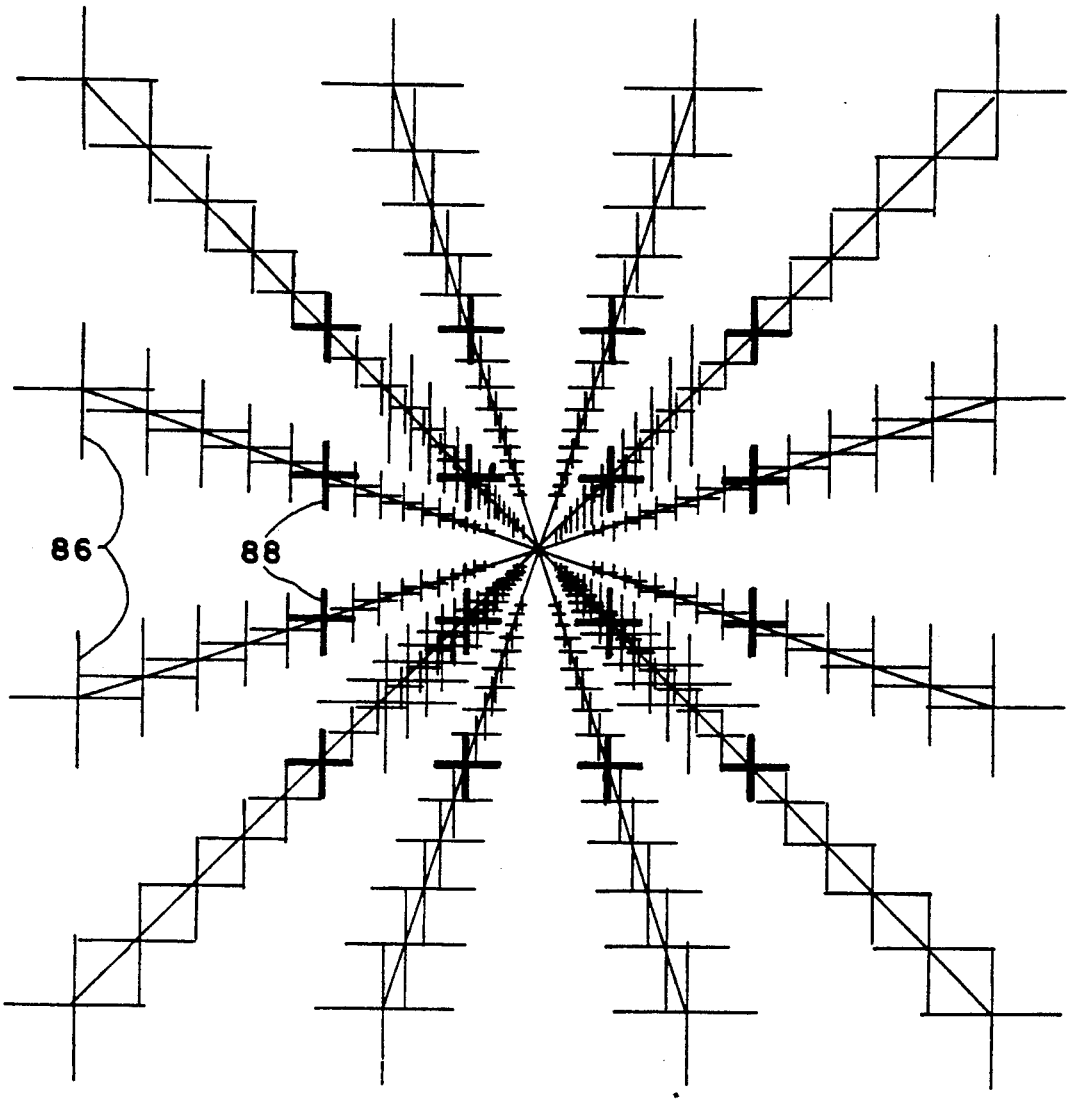
Figure 6B:
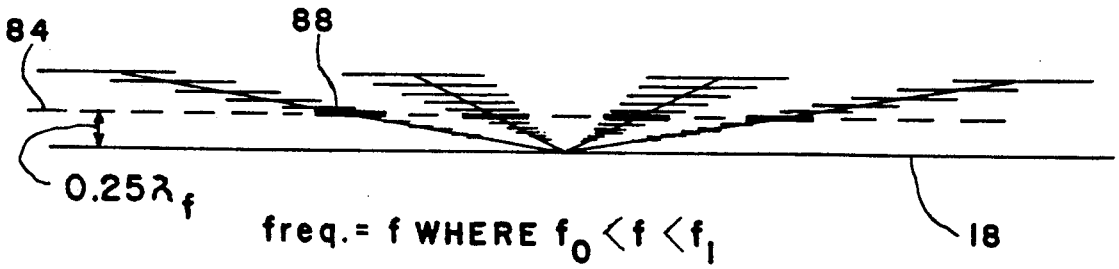

Referring now to FIG. 4, a 2×2 log-periodic antenna array is shown wherein each individual antenna employs 0.25 wavelength wire radiating elements. Radiating elements that exhibit a common resonant frequency are positioned apart by the same distances shown in FIG. 2. Again, mirror image antennas (e.g., 70, 72) are fed in the manner shown in FIG. 3, as are mirror image antennas 74, 76. Antennas 70, 72, 74 and 76 all produce linearly polarized waves which combine, dependent upon phasing of signals applied thereto, to provide a steerable pencil-beam in the manner known for phased-arrays. The structure shown in FIG. 4 can be expanded to an N×N array. In FIGS. **5*a*–7*b* a 4×4 log-periodic antenna array is shown, each antenna having radiating elements 80 which produce circularly polarized beams. Each of the antennas is fed from a central feed point 82 in the manner described in FIG. 3. Ground plane 18 is shown in FIG. 5*b*. When the 4×4 array is energized with a frequency $f_0$, a radiating surface 84 (FIG. 5*b*) is produced as a result of the resonance at $f_0$ of radiating elements 86. The antenna spacings described above are retained in the 4×4 structure shown in FIGS. 5*a* and 5*b***.

Figure 7A:
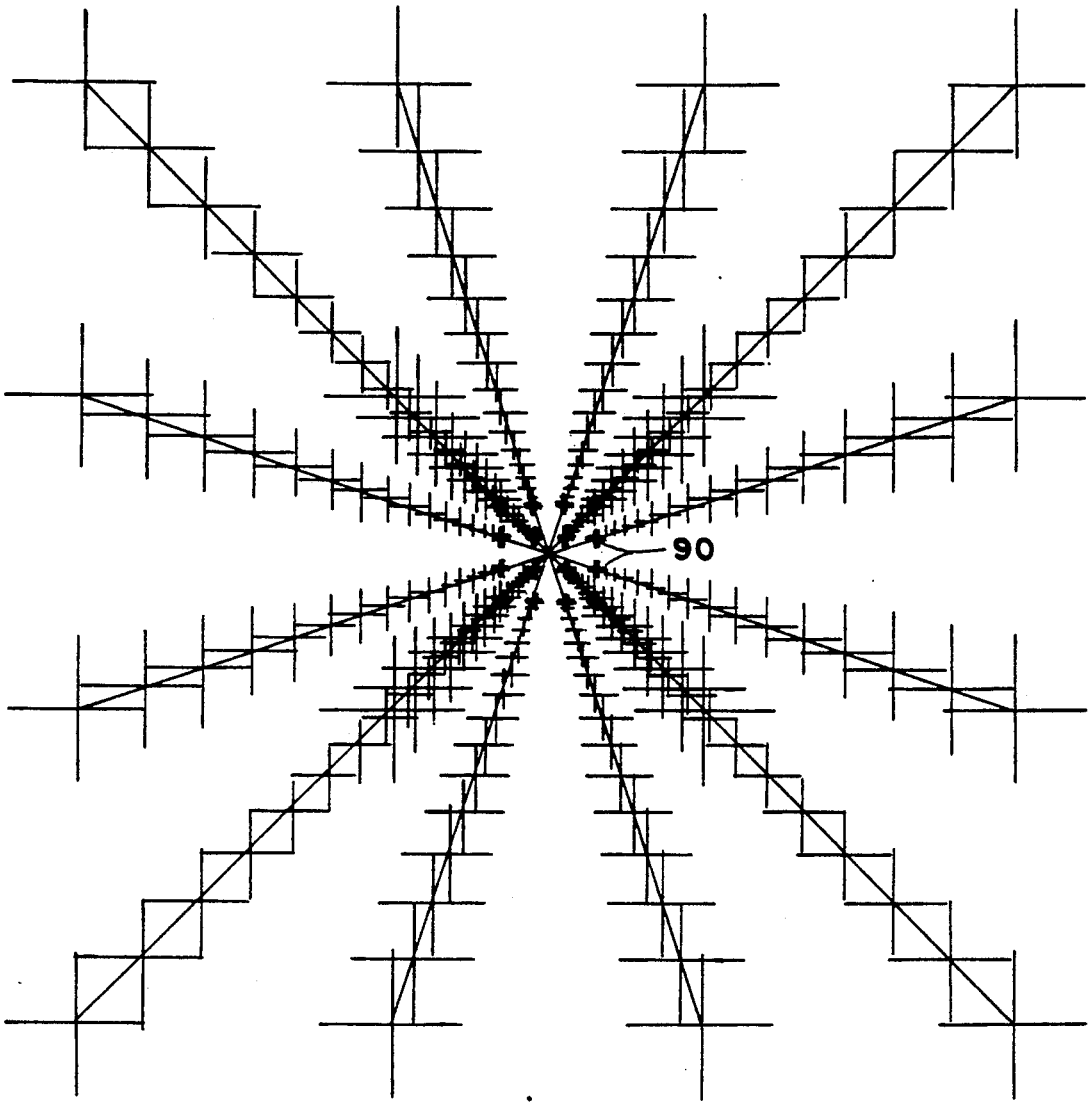
Figure 7B:
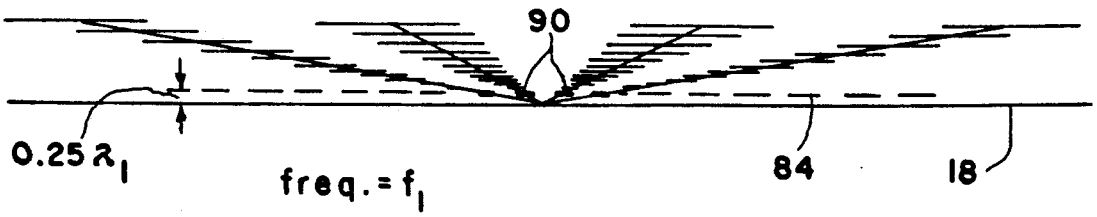

In FIGS. **6*a* and 6*b*, the excitation frequency has been changed to frequency f where f falls in between $f_0$ and $f_1$. As a result, radiating elements 88, which are resonant at frequency f, become active and create a radiating surface 84** for the phased-array antenna structure. In a similar manner, radiating surface 84 moves downwardly in the antenna structure (see FIGS. 7a and 7b) when it is energized at frequency $f_1$ where $f_1$ is the highest frequency applied to the structure. In such a case, radiating elements 90 resonate and create a slewable pencil-beam.

In summary, the antenna structure shown in FIGS. 5a–7b can be thought of as having many separate N×N vertically stacked, planar sub-arrays with fixed spacings and wavelengths. Sub-array radiating elements span from the center of the array to maintain equal electrical spacings. The highest frequency sub-array is at the lowest physical height. As the frequency of excitation is lowered, the physical plane occupied by a planar subarray successively rises from the ground plane. Heights, horizontal spacings and wavelengths of the radiating elements in each subarray are constant with frequency.

The phased array antenna described above has a number of advantages. Its highest frequency of operation can easily be extended through the inclusion of proper resonant radiating elements. In each layer of radiating elements, the number of elements can be built up in a modular fashion. For instance, the antenna might start with a 6×6 array that is totally operational as a standalone antenna. The array can further be expanded as needed by adding more radiating elements. The sense polarization can easily be reversed by a phasing control on each transmitter source. The geometrical arrangement of the radiating elements allows for a common location for feeding the antenna and avoids the need for a distributed transmitter source.

Rapid scanning is achievable due to the wide bandwidth that the array can accommodate. Since the array can be designed to have wavelength spacings of less than 0.6 wavelength for all frequencies, grating lobes are not present. In addition, amplitude and phase tapering can also be used to further improve the radiation pattern.

The maximum scan angle, with little loss in gain, is plus or minus 40 degrees from zenith. It is possible to expand the array to allow even lower angles of radiation to satisfy oblique scanning requirements. For instance, if lower angles are required for certain frequencies only, then a new set of log periodic antennas can be stacked for this frequency range in a different manner. Here, the angles for the log-periodic antennas are chosen so that like elements for the desired frequencies are in a vertical plane (rather than a horizontal plane as shown in the Figs). Thus, there can be two horizontal planes stacked over each other, for example with spacings and phasings chosen so that a much lower angle of radiation results. In essence, therefore, the antenna structure shown herein would be "tipped on its side" to provide for low-angle scanning.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. A phased antenna array comprising:

a planar conductive ground plane;

a pair of log-periodic antennas disposed in opposition about a common plane therebetween, each antenna having an axis and plural radiating elements with different resonant frequencies, there being corresponding like resonant frequency radiating elements in each antenna, like resonant frequency radiating elements in said antennas equidistantly electrically positioned from the common plane therebetween and from said ground plane, axes of said antennas intersecting at a common point with said ground plane and said common plane and extending at an acute angle assuring that said like resonant frequency radiating elements in said antennas comprise a subarray positioned at a same electrical distance in terms of wavelengths from said ground plane and when radiating at said like resonant frequency, create an effective radiating surface; and feed means for concurrently energizing said log-periodic antennas of said pair with a common frequency signal, said feed means including phase shift means for adjusting phase relationships between common frequency signals fed to antennas of said pair so as to assure a predetermined phase relationship between said common frequency signals at radiating elements in each antenna that are resonant at said common frequency signal.

2. The phased antenna array as recited in claim 1, wherein all radiating elements resonant at a like frequency in each sub-array of radiating elements are identically electrically positioned with respect to each other.

3. The phased antenna array as recited in claim 2 wherein said feed means enables said array to move a radiation beam along a slew direction from an azimuth direction perpendicular to said ground plane, by adjustment of the phase of said common frequency signal as said signal is applied to said pair of log-periodic antennas.

4. The phased array as recited in claim 3 wherein radiating elements resonant at a like frequency are arrayed at 0.25 wavelengths of said like frequency above said conductive ground plane.

5. The phased array as recited in claim 1 further comprising a plurality of pairs of log-periodic antennas, each of said pairs of said log-periodic antennas arranged as mirror images of each other about a plane common thereto, radiating elements therein that exhibit like resonant frequencies defining said effective radiating surface, radiating elements in each said radiating surface exhibiting equal electrical distances therebetween and from said ground plane.

6. The phased array as recited in claim 5 wherein each said radiating element is a quarter wavelength at a said like resonant frequency.

7. The phased array as recited in claim 6 wherein each said radiating element provides a linearly polarized beam.

8. The phased array as recited in claim 7 wherein each said radiating element provides a circularly polarized beam.

9. The phased array as recited in claim 5 wherein said feed means includes means for energizing said pairs of log-periodic antennas with a plurality of diverse frequency signals, each said log periodic antenna having a radiating element resonant at a lowest frequency energization signal and a radiating element resonant at a highest frequency energization signal.

10. The phased array as recited in claim 9, wherein a radiating element resonant at said highest frequency is physically positioned in each said antenna closest to said feed means and a radiating element resonant at said lowest frequency is positioned in each said antenna furthest away from said feed means.

* * * * *